US011529724B2

(12) United States Patent
Yoshikane et al.

(10) Patent No.: US 11,529,724 B2
(45) Date of Patent: Dec. 20, 2022

(54) STRIKING TOOL

(71) Applicant: MAKITA CORPORATION, Anjo (JP)

(72) Inventors: Kiyonobu Yoshikane, Anjo (JP); Mizuki Yamamoto, Anjo (JP)

(73) Assignee: MAKITA CORPORATION, Anjo (JP)

( * ) Notice: Subject to any disclaimer, the term of this patent is extended or adjusted under 35 U.S.C. 154(b) by 157 days.

(21) Appl. No.: 16/809,636

(22) Filed: Mar. 5, 2020

(65) Prior Publication Data

US 2020/0331135 A1 Oct. 22, 2020

(30) Foreign Application Priority Data

Apr. 18, 2019 (JP) ..... JP2019-079516

(51) Int. Cl.
*B25D 11/04* (2006.01)
*B25D 11/06* (2006.01)

(52) U.S. Cl.
CPC ..... *B25D 11/04* (2013.01); *B25D 11/064* (2013.01); *B25D 2250/085* (2013.01); *B25D 2250/345* (2013.01)

(58) Field of Classification Search
CPC ..... B25D 11/04; B25D 11/064; B25D 2250/085; B25D 2250/345; B25D 11/005; B25D 17/06; B25D 17/24; B25D 2222/57; B25D 2250/191
See application file for complete search history.

(56) References Cited

U.S. PATENT DOCUMENTS 3,921,729 A * 11/1975 Schmuck ..... B25D 11/005 173/104
4,064,949 A * 12/1977 Chromy ..... B25D 16/00 173/14

(Continued)

FOREIGN PATENT DOCUMENTS

GB 1424473 A * 2/1976 ..... B25D 11/125
GB 2313084 B * 7/1998 ..... B25D 11/005

(Continued)

OTHER PUBLICATIONS

Sep. 21, 2022 Office Action issued in Japanese Patent Application No. 2019-079516.

*Primary Examiner* — Thomas M Wittenschlaeger
*Assistant Examiner* — David G Shutty
(74) *Attorney, Agent, or Firm* — Oliff PLC

(57) ABSTRACT

A striking tool restricting movement of an intermediate member toward a striker reliably prevents no-load strokes. A hammer drill includes a cylindrical tool holder holding a tip tool, a motor, a piston that reciprocate with rotation from the motor, a striker that reciprocate in cooperation with the piston, an intermediate member reciprocably accommodated in the tool holder between the striker and the tip tool and in contact with a rear end of the tip tool at a normal strike to indirectly transmit a strike from the striker to the tip tool, and at least two ring members that move in a front-rear direction accommodated in the tool holder at a front of the intermediate member between the tool holder and the intermediate member. At least one ring member is made of metal.

7 Claims, 2 Drawing Sheets

(56) References Cited

U.S. PATENT DOCUMENTS 5,050,687 A * 9/1991 Prokhorov ..... B25D 17/06 173/133
5,603,516 A * 2/1997 Neumaier ..... B23Q 3/12 279/19.5
5,871,059 A * 2/1999 Shibata ..... B25D 11/125 173/211
6,679,411 B2 * 1/2004 Popovich ..... B25C 1/14 173/210
6,810,969 B2 * 11/2004 Meixner ..... B25D 11/04 173/104
7,357,194 B2 * 4/2008 Koschel ..... B25D 17/24 173/210
8,272,453 B2 * 9/2012 Ullrich ..... B25D 17/06 173/133
8,413,742 B2 * 4/2013 Ikuta ..... B25D 17/11 173/90
8,636,081 B2 * 1/2014 Ludy ..... B25D 11/04 173/128
9,272,408 B2 * 3/2016 Koch ..... B25D 17/24
9,656,378 B2 * 5/2017 Hartmann ..... B25D 17/06
9,873,192 B2 * 1/2018 Lauterwald ..... B25D 11/04
10,814,468 B2 * 10/2020 Krug ..... B25D 11/125
11,072,062 B2 * 7/2021 Fuenfer ..... B25D 17/24
2008/0283260 A1 * 11/2008 Kramer ..... B25D 17/26 173/128
2009/0242223 A1 * 10/2009 Miwa ..... B25D 17/06 173/117
2014/0174871 A1 * 6/2014 Yoshikane ..... B25D 16/003 192/48.1
2016/0311102 A1 * 10/2016 Ebner ..... H01M 50/247
2019/0308307 A1 * 10/2019 Young ..... B25D 16/006
2020/0331135 A1 * 10/2020 Yoshikane ..... B25D 11/04

FOREIGN PATENT DOCUMENTS

JP S-62181382 * 11/1987 ..... B25D 16/006
JP 3369844 B2 1/2003
JP 2008238331 A * 10/2008 ..... B25D 17/06

* cited by examiner

STRIKING TOOL

CROSS-REFERENCE TO RELATED APPLICATIONS

This application claims the benefit of priority to Japanese Patent Application No. 2019-079516, filed on Apr. 18, 2019, the entire contents of which are hereby incorporated by reference.

BACKGROUND

1. Technical Field

The present invention relates to a striking tool such as an electric hammer and a hammer drill.

2. Description of the Background

Striking tools, such as an electric hammer and a hammer drill, perform a striking operation using a striker that indirectly strikes, with an intermediate member, the rear end of a tip tool attached in a tool holder. Rotation from a motor is converted to reciprocation of a piston with, for example, a crank mechanism. In cooperation with the piston, the striker reciprocates in a cylinder or a tool holder.

A known striking tool includes a no-load stroke prevention mechanism for preventing a striker from striking an intermediate member when no tip tool is attached in a tool holder or pressed against a target surface (hereafter, in a non-strike state). For example, a technique described in Japanese Patent No. 3369844 (Patent Literature 1) uses an O-ring on a distal end of a cylinder and an intermediate member having a conical surface. In the non-strike state, the O-ring is engaged with the intermediate member that has been advanced further by a first no-load stroke than during a normal strike, thus applying resistance against the reciprocation of the intermediate member. This prevents a subsequent no-load stroke by restricting the intermediate member from moving toward the striker.

BRIEF SUMMARY

The technique described in Patent Literature 1 uses an O-ring, which is an elastic member, to directly restrict movement of the intermediate member. After repeated contact with the intermediate member, the O-ring may wear or deteriorate and apply a smaller resistance to the intermediate member. The O-ring may then fail to prevent no-load strokes.

One or more aspects of the present invention are directed to a striking tool that reliably prevents no-load strokes by restricting movement of an intermediate member toward a striker.

An aspect of the present invention provides a striking tool, including:

a cylindrical tool holder configured to hold a tip tool;

a motor;

a piston configured to reciprocate with rotation from the motor;

a striker configured to reciprocate in cooperation with the piston;

an intermediate member accommodated in the tool holder between the striker and the tip tool in a reciprocable manner, the intermediate member being configured to come in contact with a rear end of the tip tool at a normal strike to indirectly transmit a strike from the striker to the tip tool; and at least two ring members accommodated in the tool holder at a front of the intermediate member and between the tool holder and the intermediate member in a manner movable in a front-rear direction, wherein at least one of the ring members is made of metal.

The striking tool according to the above aspect of the present invention reliably prevents no-load strokes by restricting movement of the intermediate member toward the striker.

DETAILED DESCRIPTION

Embodiments of the present invention will now be described with reference to the drawings.

Figure 1:
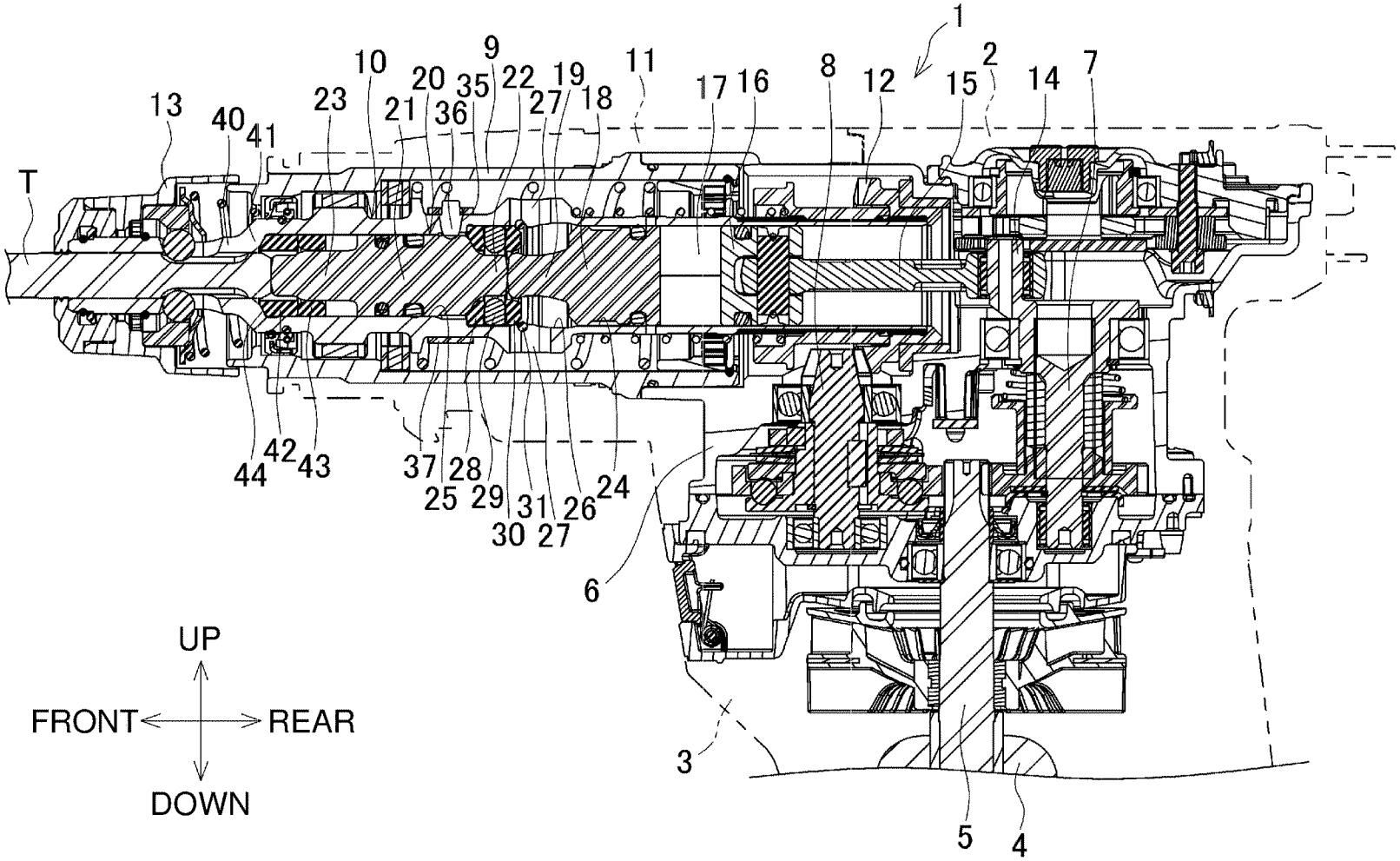
FIG. 1 is a partial longitudinal central sectional view of a hammer drill at a normal strike.

FIG. 1 is a longitudinal central sectional view of a hammer drill 1 as an example of a striking tool.

The hammer drill 1 includes a body housing 2, a motor housing 3, a gear housing 6, a front housing 9, and a handle housing (not shown). The motor housing 3 is connected to a front lower portion of the body housing 2 in the vertical direction. The motor housing 3 accommodates a motor 4 with an output shaft 5 extending upward. The gear housing 6 is located above the motor housing 3. The gear housing 6 accommodates a crank shaft 7 and an countershaft 8. The crank shaft 7 and the countershaft 8 each mesh with the output shaft 5. The front housing 9 is mounted onto the front of the gear housing 6. The front housing 9 accommodates a cylindrical tool holder 10 facing frontward. The handle housing is connected to the rear of the body housing 2. The handle housing includes a switch and a switch lever, and is connected with a power cable. A housing cover 11 covering the front housing 9 is connected to the front of the body housing 2.

The countershaft 8 meshes with a bevel gear 12 located on the rear end of the tool holder 10. The tool holder 10 can receive a tip tool T, such as a drill bit, on a distal end with an operation sleeve 13.

The tool holder 10 contains a piston 16. The piston 16 is connected to an eccentric pin 14 on the crank shaft 7 with a connecting rod 15 in between, and reciprocates. A striker 18 and an intermediate member 20 are located in a reciprocable manner in front of the piston 16 with an air chamber 17 in between, forming a striking mechanism. The striker 18 includes a front shaft 19 protruding frontward. The intermediate member 20 is located in front of the striker 18.

The intermediate member 20 includes a larger-diameter portion 21, a rear shaft 22, and a smaller-diameter portion 23. The larger-diameter portion 21 is located in the middle of the intermediate member 20 and slides on the inner surface of the tool holder 10. The rear shaft 22 is located at the rear of the intermediate member 20. The rear shaft 22 has a gradually decreasing diameter rearward, and protrudes rearward coaxially with the larger-diameter portion 21. The smaller-diameter portion 23 is located at the front of the intermediate member 20. The smaller-diameter portion 23 has a smaller diameter than the larger-diameter portion 21, and protrudes frontward coaxially with the larger-diameter portion 21.

The tool holder 10 has a rear guide surface 24 and a front guide surface 25 as its inner circumferential surface. The rear guide surface 24 receives the piston 16 and the striker 18. The front guide surface 25 has a smaller diameter than the rear guide surface 24. The front guide surface 25 receives the intermediate member 20. The rear guide surface 24 partly has a non-guide surface 26 in front of the striker 18 at an advanced position at a normal strike shown in FIG. 1. The non-guide surface 26 has a diameter larger than the inner diameter of the rear guide surface 24 and is not in contact with the peripheral surface of the striker 18 advanced by a no-load stroke. The non-guide surface 26 of the tool holder 10 has a vent 27 allowing passage into and out of the tool holder 10.

The rear guide surface 24 inside the tool holder 10 receives, at its front end, a front receiving ring 28, a holding ring 29, and a rear receiving ring 30. The rear shaft 22 of the intermediate member 20 extends through the front receiving ring 28, which receives the rear end of the larger-diameter portion 21. The holding ring 29 is located behind the front receiving ring 28 and holds the front shaft 19 of the striker 18 when the striker 18 is advanced by a no-load stroke. The rear receiving ring 30 is located behind the holding ring 29. The front shaft 19 extends through the rear receiving ring 30, which receives the front end of the striker 18.

With the front receiving ring 28 being pressed against a step between the rear guide surface 24 and the front guide surface 25 and being restricted from moving forward, the holding ring 29 and the rear receiving ring 30 are located in this order. In this state, the rear receiving ring 30 is restricted from moving rearward by an engagement ring 31, which is engaged with the rear guide surface 24. This positions the front receiving ring 28, the holding ring 29, and the rear receiving ring 30 in the front-rear direction.

The front guide surface 25 in the tool holder 10 has, in its rear portion, a radially extending through-hole 35. The through-hole 35 is tapered radially from outside to inside. The through-hole 35 receives a resistor pin 36, which is a metal shaft tapered to fit in the through-hole 35 and has a hemispherical tip.

A leaf spring 37 is externally mounted on the tool holder 10 on its peripheral surface at the position of the resistor pin 36. The leaf spring 37 is a metal strip bent in a C shape. With a base end of the resistor pin 36 received through its end in the longitudinal direction, the leaf spring 37 presses the resistor pin 36 toward the center of the tool holder 10 to urge the resistor pin 36 to have its tip protruding inward from the through-hole 35.

The tool holder 10 has, in front of the intermediate member 20, a small-diameter distal end 40, which can loosely receive the tip tool T and the smaller-diameter portion 23. An annular step 41 tapered frontward is located between the distal end 40 and the front guide surface 25.

A front ring 42 and a rear ring 43 are accommodated in a manner movable in the front-rear direction behind the step 41 and at the front of the intermediate member 20. The rings 42 and 43 are both formed from metal, and have inner diameters sized to loosely receive the smaller-diameter portion 23. The front ring 42 is longer than the rear ring 43 in the axial direction. The front ring 42 has the front surface including a circular tapered surface 44 in conformance with the sloping inner surface of the step 41.

This structure allows the intermediate member 20 to be in contact with the rear ring 43 instead of directly being in contact with the step 41 when the intermediate member 20 advances further at a normal strike.

The body housing 2 includes, on its left side, a change lever (not shown) for selecting a mode from a hammer mode, a drill mode, and a hammer-drill mode. In a hammer mode, the crank shaft 7 rotates to strike the tip tool T. In a drill mode, the countershaft 8 rotates to rotate the tip tool T together with the tool holder 10. In a hammer-drill mode, the crank shaft 7 and the countershaft 8 rotate together to strike and rotate the tip tool T.

The tip tool T is inserted through the distal end of the tool holder 10. The distal end of the tip tool T is then pressed against the target surface. The tip tool T is then pressed to move the intermediate member 20 rearward. The intermediate member 20 then comes in contact with the front receiving ring 28 to restrict the rearward movement of the intermediate member 20 at a retracted position at which the rear shaft 22 is in the rear receiving ring 30 as shown in FIG. 1. At the retracted position, the tip of the resistor pin 36 protruding inside the tool holder 10 is in contact with the larger-diameter portion 21 of the intermediate member 20. In this state, the resistor pin 36 is retracted radially outward through the through-hole 35 against the urging force from the leaf spring 37, and has its tip pressed against the peripheral surface of the larger-diameter portion 21.

The switch lever is pressed in the hammer mode or the hammer-drill mode selected with the change lever to turn on the switch. This drives the motor 4 to turn the output shaft 5 to rotate the crank shaft 7. The eccentric pin 14 moves eccentrically to reciprocate the piston 16 with the connecting rod 15. This reciprocates the striker 18 through the air chamber 17, causing the front shaft 19 of the striker 18 to strike the rear shaft 22 of the intermediate member 20 inside the rear receiving ring 30. The striker 18 indirectly strikes the tip tool T with the intermediate member 20 between them in this manner, allowing the tip tool T to, for example, cut the target surface. In this state, the larger-diameter portion 21 of the intermediate member 20 is spaced from the rear ring 43 without restricting movement of the front ring 42 and the rear ring 43 in the front-rear direction.

Figure 2:
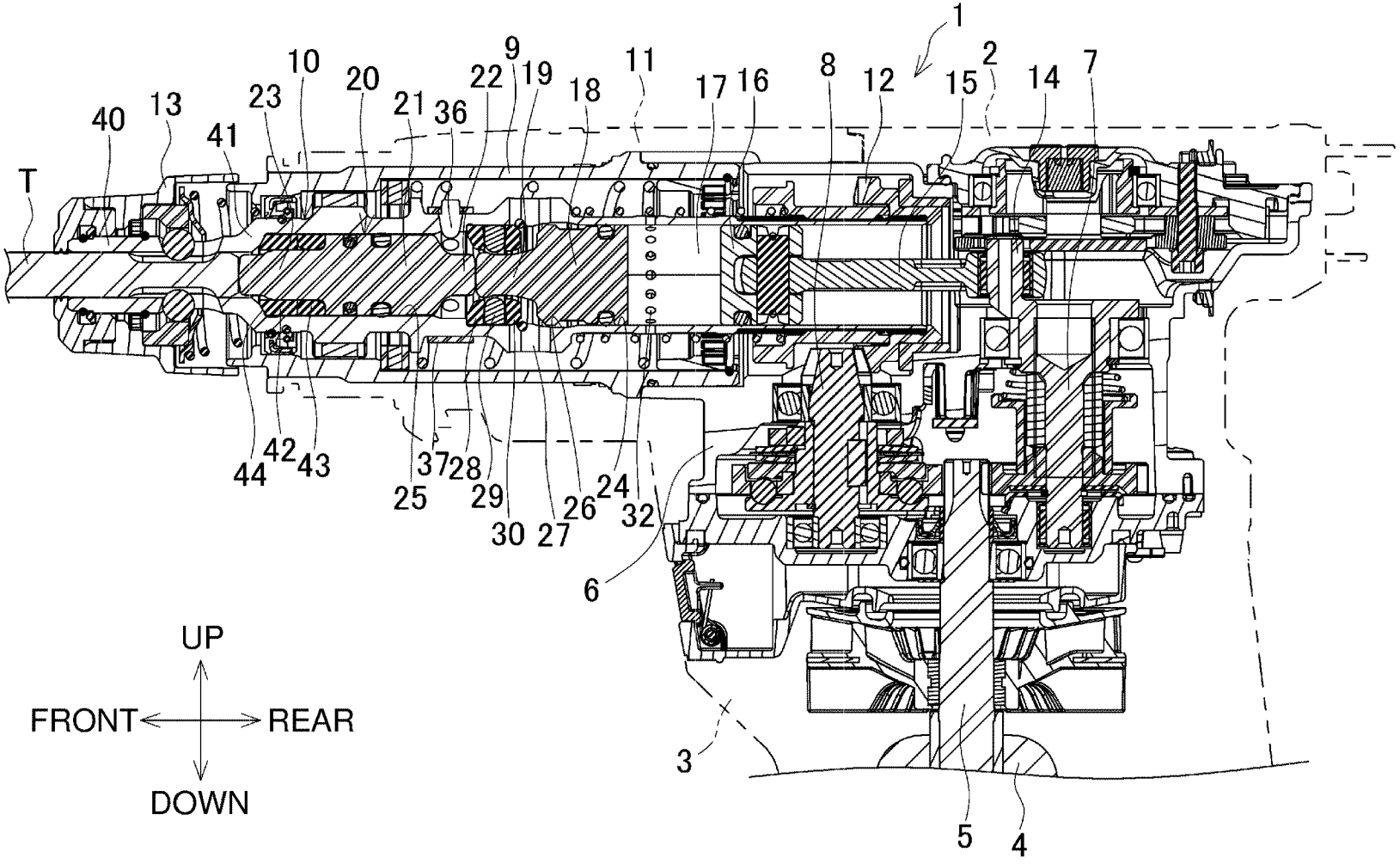
FIG. 2 is a partial longitudinal central sectional view of the hammer drill in a non-strike state.

The switch lever may be pressed in the non-strike state, in which the tip tool T is not pressed against the target surface (or the tip tool T is not attached in the tool holder 10). In this case, the intermediate member 20 is moved forward from the retracted position by the first strike (no-load stroke) with the striker 18 as shown in FIG. 2. The intermediate member 20, pressed by the resistor pin 36 under resistance from radially outside, advances while decelerating.

The advanced intermediate member 20 then comes in contact with the rear ring 43. The front ring 42 and the rear ring 43 are not restricted from moving in the front-rear direction in the tool holder 10 as described above. Thus, the front ring 42 and the rear ring 43 move rearward with, for example, the pressed tip tool T, while increasing the likelihood of leaving clearances between the step 41 and the front ring 42 and between the front ring 42 and the rear ring 43. Thus, when the rear ring 43 in contact with the intermediate member 20 comes in contact with the front ring 42 or the front ring 42 comes in contact with the step 41, the intermediate member 20 irregularly bounces with a smaller bounce distance, and subsequently prevents no-load strokes.

Although the intermediate member 20 bounces, the tip of the resistor pin 36 that has returned to the protruding position as the intermediate member 20 advances is engaged with the rear end of the larger-diameter portion 21 from the rear. The intermediate member 20 is restricted from moving rearward and does not return to the retracted position.

The striker 18 advanced by the first no-load stroke has the distal end of the front shaft 19 placed inside the front receiving ring 28. The tool holder 10 radially has a plurality of ventilation holes 32 (FIG. 2) that are open when the striker 18 advances. This causes the air chamber 17 to communicate with the outside of the tool holder 10 and may lose its function as an air spring. The striker 18 is then held at the position at which the distal end of the front shaft 19 fitted with the holding ring 29, disabling the cooperation with the piston 16.

The rear guide surface 24 of the tool holder 10 has the non-guide surface 26 with a larger diameter than the striker 18. Thus, when the striker 18 advanced by the first no-load stroke moves inside the non-guide surface 26, the rear guide surface 24 can no longer guide advancement. The striker 18 is likely to shift from the reciprocation axis of a normal strike, and to reduce the striking force against the intermediate member 20 at the first no-load stroke. The front end face of the front shaft 19 of the striker 18 and the rear end face of the rear shaft 22 of the intermediate member 20 are spherical and curved toward each other. Although the striker 18 tilts slightly, the front shaft 19 can appropriately come in contact with the rear shaft 22.

The hammer drill 1 according to the present embodiment includes the front ring 42 and the rear ring 43 (two ring members) accommodated in the tool holder 10 at the front of the intermediate member 20 and between the tool holder 10 and the intermediate member 20 in a manner movable in the front-rear direction. A small clearance left between the front ring 42 and the rear ring 43 causes the intermediate member 20 to bounce irregularly at a smaller bounce distance. The structure that restricts the movement of the intermediate member 20 toward the striker 18 can reliably prevent no-load strokes.

In particular, the structure simply including two ring members, namely, the front ring 42 and the rear ring 43, can prevent no-load strokes while minimizing the number of components to be added.

Additionally, the front ring 42 and the rear ring 43 are both formed from metal and thus are highly durable.

The intermediate member 20 includes the larger-diameter portion 21 slidable on the inner surface of the tool holder 10, and the smaller-diameter portion 23 protruding frontward from the larger-diameter portion 21 to be loosely received in the front ring 42 and the rear ring 43. The smaller-diameter portion 23 reliably positions the front ring 42 and the rear ring 43 frontward.

Additionally, the tool holder 10 includes the annular tapered step 41, and the front ring 42 has the front surface including the tapered surface 44 shaped in conformance with the step 41 and in contact with the step 41. The front ring 42 can thus be placed in an appropriate posture inside the tool holder 10.

The tool holder 10 also includes the resistor pin 36 (resistor) that may be in contact with the intermediate member 20 in the non-strike state and apply resistance against the reciprocation of the intermediate member 20. The intermediate member 20 advanced by a no-load stroke decelerates, with bouncing reduced more effectively.

The resistor may apply resistance to the tip tool, rather than applying resistance to the intermediate member. The number of resistors and their positions may be changed as appropriate. The resistor may be eliminated. The non-guide surface may also be eliminated.

Although the two ring members are used in the above embodiment, three or more ring members may be used. Each ring member may have any shape as appropriate.

Although the ring members all formed from metal provide durability, one of the ring members may be formed from an elastic material, such as rubber. The ring member formed from an elastic material may absorb the momentum of the advancing intermediate member. The ring member formed from an elastic material may be the front ring member.

The ring member formed from an elastic material may have the outer circumferential surface in contact with the inner surface of the tool holder and the inner circumferential surface in contact with the outer surface of the intermediate member. This reduces deformation of the ring member to provide longer durability and fill any space between the ring member and the intermediate member to provide cushioning.

A hammer drill may use another striking mechanism including, for example, a piston cylinder connected to an arm that is swingably mounted on a boss sleeve, which is mounted on a countershaft parallel to a tool holder. The piston cylinder is reciprocable with the arm on the boss sleeve mounted with a swash bearing having a tilted axis. This striking mechanism may also include a ring member in front of an intermediate member. The orientation and the type of the motor are not limited to those described in the above embodiment, and a model driven with direct current (DC) using a battery pack may be used instead of a model driven with alternating current (AC).

The striking tool according to embodiments is not limited to the hammer drill, and may be an electric hammer simply including a striking mechanism.

REFERENCE SIGNS LIST

1 hammer drill
2 body housing
3 motor housing
4 motor
5 output shaft
10 tool holder
14 eccentric pin
15 connecting rod
16 piston
17 air chamber
18 striker
20 intermediate member
21 larger-diameter portion
23 smaller-diameter portion
36 resistor pin
40 distal end
41 step
42 front ring
43 rear ring
44 tapered surface
T tip tool

What is claimed is:

1. A striking tool, comprising:

a cylindrical tool holder configured to hold a tip tool and having a longitudinal axis;

a motor;

a piston configured to reciprocate with rotation from the motor;

a striker configured to reciprocate in cooperation with the piston;

an intermediate member in the tool holder between the striker and an end of the tool holder configured to receive the tip tool, configured to reciprocate in the tool holder, configured to come in contact with a rear end of the tip tool at a normal strike to indirectly transmit a strike from the striker to the tip tool, and including a larger-diameter portion configured to slide on an inner surface of the tool holder, and a smaller-diameter portion protruding frontward from the larger-diameter portion; and a first ring member and a second ring member in the tool holder at a front of the larger-diameter portion and between the tool holder and the larger-diameter portion in directions parallel to the longitudinal axis, wherein:

the first ring member and the second ring member are side-by-side along the longitudinal axis;

the first ring member and the second ring member are made of metal; and each of the first ring member and the second ring member can move independently of another of the first ring member and the second ring member along the longitudinal axis relative to the tool holder such that the first ring member and the second ring member can come into and out of direct contact with each other.

2. The striking tool according to claim 1, wherein the smaller-diameter portion is loosely received in the ring members.

3. The striking tool according to claim 2, wherein the tool holder includes an annular tapered step, and at least one of the ring members includes, on a front surface of the ring member, a tapered surface shaped in conformance with the step and in contact with the step.

4. The striking tool according to claim 2, wherein the tool holder includes a resistor configured to be in contact with the intermediate member in a non-strike state and to apply resistance against reciprocation of the intermediate member.

5. The striking tool according to claim 1, wherein the tool holder includes an annular tapered step, and at least one of the ring members includes, on a front surface of the ring member, a tapered surface shaped in conformance with the step and in contact with the step.

6. The striking tool according to claim 5, wherein the tool holder includes a resistor configured to be in contact with the intermediate member in a non-strike state and to apply resistance against reciprocation of the intermediate member.

7. The striking tool according to claim 1, wherein the tool holder includes a resistor configured to be in contact with the intermediate member in a non-strike state and to apply resistance against reciprocation of the intermediate member.

* * * * *